US009528695B2

(12) United States Patent
Adachi et al.

(10) Patent No.: US 9,528,695 B2
(45) **Date of Patent: *Dec. 27, 2016**

(54) MIRROR UNIT AND LIGHT SOURCE FOR ILLUMINATION

(75) Inventors: Kazufumi Adachi, Kawasaki (JP); Kazunaga Ida, Kawasaki (JP); Taku Ito, Kawasaki (JP); Harumi Nakamura, Kawasaki (JP); Meiji Kitamura, Kawasaki (JP); Takeshi Nakamura, Kawasaki (JP); Yosuke Sato, Yonezawa (JP); Takuo Shinohara, Kawasaki (JP)

(73) Assignees: PIONEER CORPORATION, Kawasaki-Shi, Kanagawa (JP); TOHOKU PIONEER CORPORATION, Tendo-Shi, Yamagata (JP)

( * ) Notice: Subject to any disclaimer, the term of this patent is extended or adjusted under 35 U.S.C. 154(b) by 194 days.

This patent is subject to a terminal disclaimer.

(21) Appl. No.: 14/348,233

(22) PCT Filed: Sep. 30, 2011

(86) PCT No.: PCT/JP2011/072576

§ 371 (c)(1),
(2), (4) Date: Jun. 19, 2014

(87) PCT Pub. No.: WO2013/046436

PCT Pub. Date: Apr. 4, 2013

(65) Prior Publication Data

US 2015/0159856 A1 Jun. 11, 2015

(51) Int. Cl.
*F21V 33/00* (2006.01)
*A47G 1/02* (2006.01)
(Continued)

(52) U.S. Cl.
CPC ..... *F21V 33/004* (2013.01); *A45D 42/10* (2013.01); *A47G 1/02* (2013.01); *F21V 33/0056* (2013.01);
(Continued)

(58) Field of Classification Search
CPC ..... A45D 42/10; A45D 42/18; F21V 33/0056; F21V 33/004; A47G 1/02
See application file for complete search history.

(56) References Cited

U.S. PATENT DOCUMENTS 3,757,103 A * 9/1973 Walter ..... F21V 33/00 362/129
3,794,828 A * 2/1974 Arpino ..... A45C 5/005 307/38

(Continued)

FOREIGN PATENT DOCUMENTS

JP 64-27058 B 2/1989
JP 02-080009 A1 3/1990

(Continued)

OTHER PUBLICATIONS

International Search Report and Written Opinion dated Dec. 20, 2011, issued for International Application No. PCT/JP2011/072576.

*Primary Examiner* — Robert May
(74) *Attorney, Agent, or Firm* — Procopio, Cory, Hargreaves & Savitch LLP

(57) ABSTRACT

An illuminated makeup mirror set includes: a mirror unit; a surface light source with adjustable color that is used to illuminate a makeup subject; a setting unit for setting illumination conditions with the surface light source according to an input operation; an adjustment unit for adjusting color and brightness of the surface light source according to the illumination conditions set by the setting unit; a speaker; and a playback unit that stores a plurality of musical pieces as data, plays a musical piece selected from the plurality of musical pieces according to the illumination conditions and time of illumination with the surface light source, and causes the speaker to output the selected musical piece as a reproduced sound.

10 Claims, 10 Drawing Sheets

(51) Int. Cl.

| | |
|---|---|
| ***A45D 42/10*** | (2006.01) |
| ***H04R 1/02*** | (2006.01) |
| *F21V 23/00* | (2015.01) |
| *F21W 131/302* | (2006.01) |

(52) U.S. Cl.
CPC ..... *H04R 1/028* (2013.01); *F21V 23/003* (2013.01); *F21W 2131/302* (2013.01); *H04R 2201/025* (2013.01)

(56) References Cited

U.S. PATENT DOCUMENTS

| | | | | |
|---|---|---|---|---|
| 5,228,879 | A * | 7/1993 | Fromm | A63H 33/22 362/140 |
| 6,604,836 | B2 * | 8/2003 | Carlucci | A45D 42/10 362/135 |
| 7,222,977 | B1 * | 5/2007 | Darling | A63H 33/22 359/839 |
| 7,394,538 | B2 * | 7/2008 | Bazin | A45D 42/10 356/364 |
| 2011/0228155 | A1 * | 9/2011 | Lee | A45D 42/00 348/333.01 |
| 2014/0195246 | A1 * | 7/2014 | Maynor | A47G 1/02 704/275 |

FOREIGN PATENT DOCUMENTS

| | | | | |
|---|---|---|---|---|
| JP | 2001-286373 | A1 | 10/2001 | |
| JP | 2008-018058 | A1 | 1/2008 | |
| JP | 3147323 | B | 12/2008 | |
| JP | 2009-125114 | A1 | 6/2009 | |
| TW | GB 2307403 | A * | 5/1997 | A45D 44/02 |

* cited by examiner

MIRROR UNIT AND LIGHT SOURCE FOR ILLUMINATION

TECHNICAL FIELD

The present invention relates to an illuminated makeup mirror set including a mirror unit and a light source for illumination.

BACKGROUND ART

When makeup (including hair styling) is put on a model or actress, illumination is necessary to clearly reflect the process of the makeup in a mirror. One known illumination light fixture is a so-called Hollywood light fixture including a plurality of light sources arranged in a row. An illuminated makeup mirror set including a makeup mirror and Hollywood light fixtures disposed on opposite sides of the makeup mirror has been commercially available as a makeup case. In these Hollywood light fixtures, the light sources used are generally incandescent lamps, which are point light sources.

In addition, an illuminated makeup mirror set including a makeup mirror and a lighting fixture with variable illumination characteristics is known (Patent Document 1). In the illuminated makeup mirror set in Patent Document 1, data of the illumination characteristics of illumination light for a scene selected by the user is acquired from a possible scene illumination database pre-stored in a memory unit. Then a control signal for illumination with the acquired illumination characteristics is supplied to the lighting fixture, and the lighting fixture provides illumination according to the control signal.

CITATION LIST

Patent Documents

Patent Document 1: Japanese Patent Application Laid-Open No. 2009-125114

SUMMARY OF THE INVENTION

Problem to be Solved by the Invention

In the conventional illuminated makeup mirror set, the illumination conditions optimal for the selected scene can be set as described above. However, the mood of the makeup subject whose image is reflected in the mirror surface of the makeup mirror set is not taken into consideration. Therefore, the makeup subject does not obtain enough satisfaction with the makeup, and makeup time increases significantly for some cases.

One example of problems to be solved by the present invention is the above-described drawback, and it is an object of the present invention to provide an illuminated makeup mirror set that allows a makeup subject to wear makeup in a good mood.

Means to Solve the Problem

An illuminated makeup mirror set in an invention according to claim 1 is an illuminated makeup mirror set comprising a mirror unit, the illuminated makeup mirror set further comprising: a surface light source with adjustable color that is used to illuminate a makeup subject; a setting unit for setting illumination conditions with the surface light source according to an input operation; an adjustment unit for adjusting color and brightness of the surface light source according to the illumination conditions set by the setting unit; a speaker; and a playback unit that stores a plurality of musical pieces as data, plays a musical piece selected from the plurality of musical pieces according to the illumination conditions and time of illumination with the surface light source, and causes the speaker to output the selected musical piece as a reproduced sound.

DESCRIPTION OF EMBODIMENTS

The illuminated makeup mirror set in the invention according to claim 1 includes a playback unit that stores a plurality of musical pieces as data, plays a musical piece selected from the plurality of musical pieces according to the illumination conditions and time of illumination with the surface light source, and outputs the selected musical piece as a reproduced sound from the speaker. Therefore, when makeup is applied to the makeup subject, the musical piece allows the makeup subject to be in a high mood or to relax as the makeup progresses. More specifically, the makeup can be applied to the makeup subject in a good mood. Therefore, the makeup subject can obtain higher satisfaction with the makeup, and the makeup time can thereby be reduced.

EMBODIMENTS

Embodiments of the present invention will next be described in detail with reference to the drawings.

Figure 1:
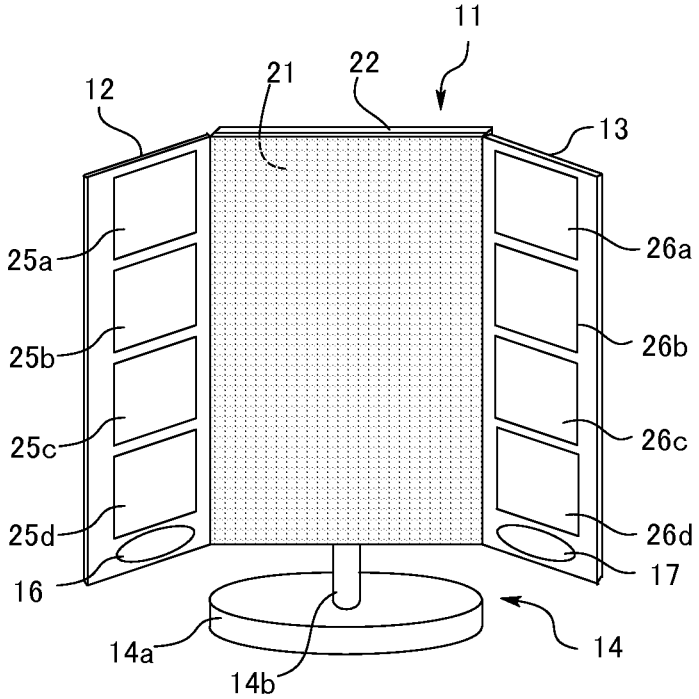
FIG. 1 is an external view of an illuminated makeup mirror set in an embodiment of the present invention.
Figure 2:
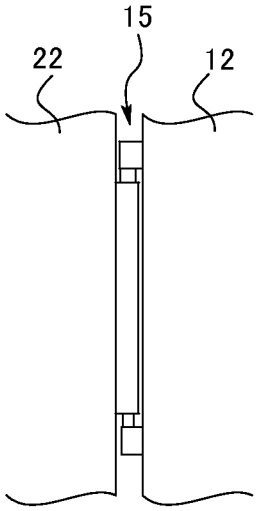
FIG. 2 is a diagram illustrating a hinge mechanism in the makeup mirror set in FIG. 1.

FIG. 1 shows an illuminated makeup mirror set, which is an embodiment of the invention according to claim 1. This makeup mirror set includes a mirror unit 11, left and right side plates 12 and 13, and a support 14. The mirror unit 11 includes a rectangular mirror 21 and a flat plate 22 affixed to the rear face of the mirror 21. The flat plate 22 is formed from a resin, wood, or a metal and may have the same size as the mirror 21 or may be slightly larger than the mirror 21. The left side plate 12 is connected to the left edge of the mirror unit 11 such that the angle therebetween is freely adjustable, and the right side plate 13 is connected to the right edge of the mirror unit 11 such that the angle therebetween is freely adjustable. A hinge mechanism 15 is formed between the mirror unit 11 and each of the side plates 12 and 13, as shown in FIG. 2, and these hinge mechanisms 15 allow the above connection angles to be freely adjustable. Each of these angles can be adjusted within the range of from an angle at which the mirror unit 11 and one of the side plates 12 and 13 are substantially flush with each other to an angle at which the one of the side plates 12 and 13 is folded with respect to the mirror unit 11.

The vertical length (in the up-and-down direction) of each of the side plates 12 and 13 is the same as the vertical length of the mirror unit 11, but the horizontal length (in the left-and-right direction) of each of the side plates 12 and 13 is equal to or less than ½ of the horizontal length of the mirror unit 11.

Four organic EL (Electro Luminescence) panels (surface light sources) 25*a* to 25*d* and four organic EL panels 26*a* to 26*d* used to illuminate the makeup subject are vertically arranged on and attached to the surfaces of the side plates 12 and 13, respectively. The organic EL panels 25*a* to 25*d* and 26*a* to 26*d* are identical and have a square shape of, for example, 13 cm×13 cm. Flat speakers 16 and 17 are attached to the side plates 12 and 13 at positions below the organic EL panels 25*d* and 26*d*.

The support 14 includes an elliptical flat base 14*a* and a strut 14*b*, and the strut 14*b* is vertically connected to the base 14*a*. The strut 14*b* of the support 14 is detachably connected to the mirror unit 11 to support the mirror unit 11 including the side plates 12 and 13. For example, a connection hole (not shown) is formed in a lower portion of the mirror unit 11. The top end portion of the strut 14*b* is inserted into the connection hole, and the support 14 is thereby connected to the mirror unit 11.

In the makeup mirror set in FIG. 1 having the above-described configuration, the user such as a makeup artist operates the side plates 12 and 13 with their joints to the mirror unit 11 (the hinge mechanisms 15) serving as rotation axes to thereby adjust the angles between the mirror unit 11 and the side plates 12 and 13. More specifically, the angles between the mirror unit 11 and the side plates 12 and 13 can be adjusted such that an image of a makeup subject such as a model that is reflected in the mirror surface of the mirror 21 is preferably illuminated with light emitted from the organic EL panels 25*a* to 25*d* and 26*a* to 26*d* on the side plates 12 and 13.

Figure 3:
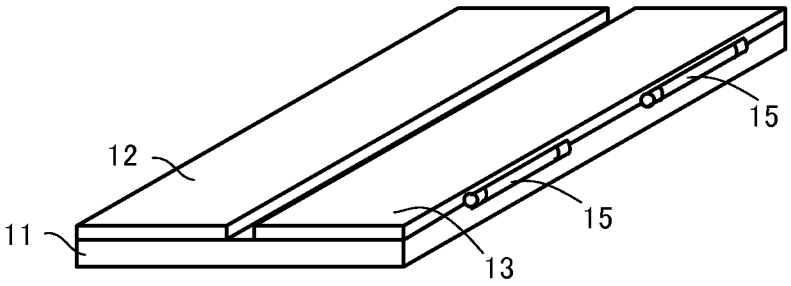
FIG. 3 is an external view of the makeup mirror set in FIG. 1 in a folded state.

The side plates 12 and 13 can be folded respectively as shown in FIG. 3 with the organic EL panels 25*a* to 25*d* and 26*a* to 26*d* disposed thereon. In the folded state, the side plates 12 and 13 are not in contact with each other. Since the thickness of the organic EL panels 25*a* to 25*d* and 26*a* to 26*d* is small, the organic EL panels 25*a* to 25*d* and 26*a* to 26*d* do not come into pressure contact with the mirror 21.

The support 14 can be detached from the mirror unit 11 to separate the support 14 from the mirror unit 11 and the side plates 12 and 13. Then the side plates 12 and 13 can be folded with respect to the mirror unit 11 as described above, whereby the makeup mirror set can be easily conveyed.

Next, a description will be given of the organic EL panels 25*a* to 25*d* and 26*a* to 26*d* in the makeup mirror set in FIG. 1 and their driving system.

Figure 4:
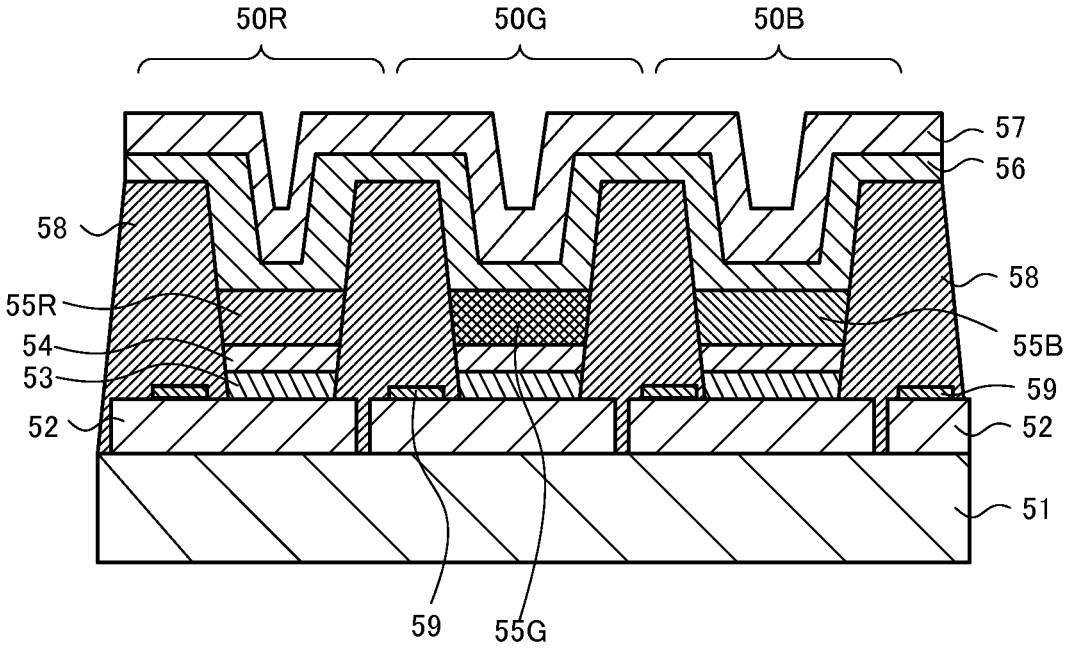
FIG. 4 is a cross-sectional view illustrating the structure of an organic EL panel in the makeup mirror set in FIG. 1.

Each of the organic EL panels 25*a* to 25*d* and 26*a* to 26*d* is a full-color illumination light-emitting panel, and stripe-shaped organic EL elements 50R, 50G, and 50B with emission colors of R (red), G (green), and B (blue) are formed on a glass substrate 51, as shown in FIG. 4. In FIG. 4, a cross section in a direction orthogonal to the straight stripes is shown.

Each of the organic EL elements 50R, 50G, and 50B has a structure in which an anode 52, a hole injection layer 53, a hole transport layer 54, an RGB light-emitting layer 55R, 55G, or 55B, an electron transport layer 56, and a cathode 57 are stacked in that order. The organic EL elements 50R, 50G, and 50B are partitioned by banks 58. Bus lines 59 are formed on the anodes 52 of the respective organic EL elements 50R, 50G, and 50B, and the anodes 52 are energized through the bus lines 59. Each anode 52 is formed of, for example, an ITO film formed by sputtering and having a thickness of 70 nm. Each hole injection layer 53 is formed of CuPc and has a thickness of 20 nm. Each hole transport layer 54 is formed of NPB and has a thickness of 20 nm. Each R (red) light-emitting layer 55R is formed of CPB as a host material and $Ir(phq)_2tpy$ as a dopant. Each G (green) light-emitting layer 55G is formed of CPB as a host material and $Ir(ppy)_3$ as a dopant, and each B (blue) light-emitting layer 55B is formed of PAND as a host material and DPAVBi as a dopant. The thicknesses of the RGB light-emitting layers 55R, 55G, and 55B are 40 nm. Each electron transport layer 56 is formed of CsxMoOx-doped NBphen and has a thickness of 30 nm. Each cathode 57 is formed of an Al film having a thickness of 70 to 100 nm. The internal structure of each of the organic EL panels 25*a* to 25*d* and 26*a* to 26*d* is only an example, and the present invention is not limited thereto.

Figure 5:
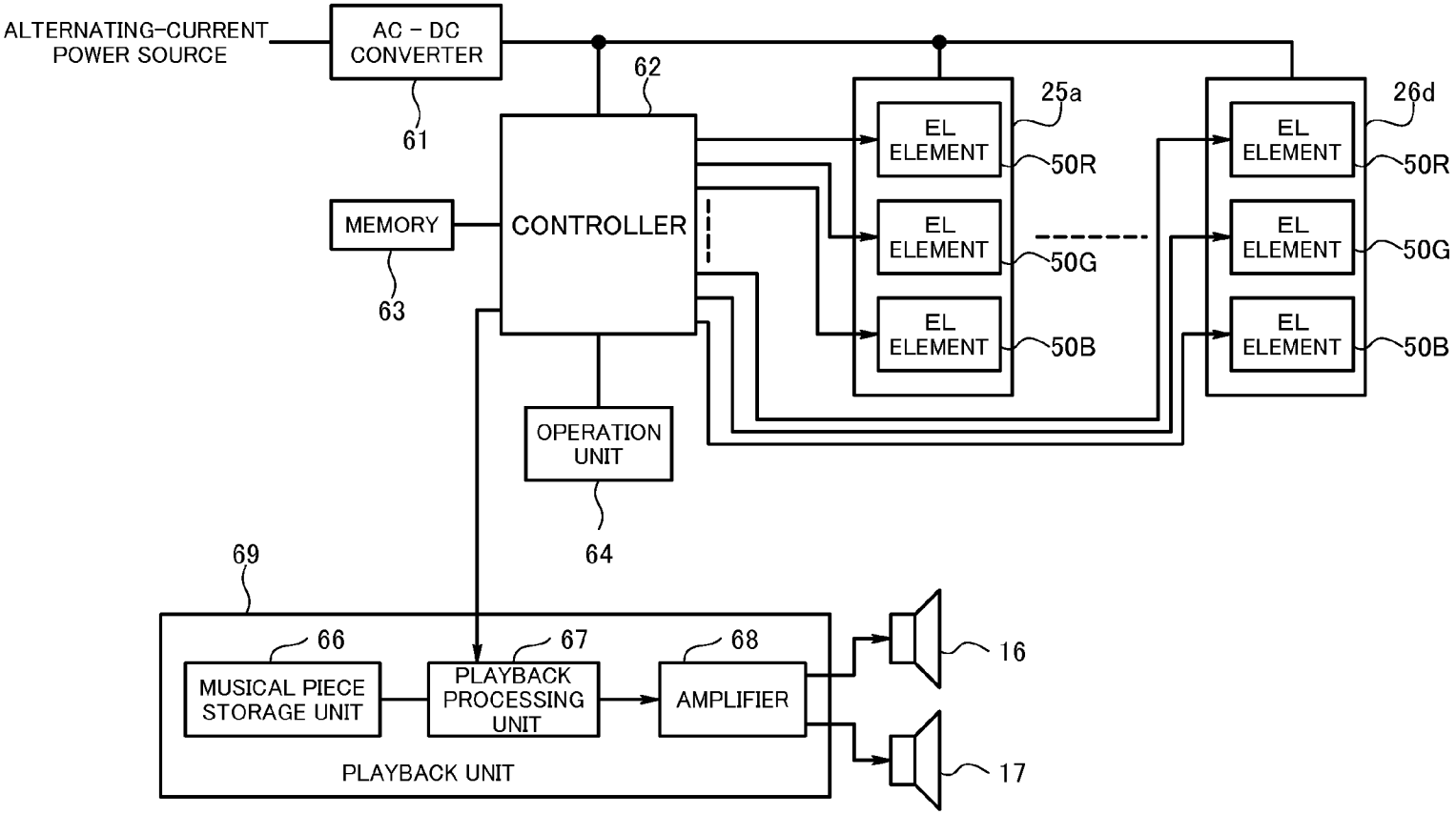
FIG. 5 is a block diagram showing the configuration of a driving unit in the makeup mirror set in FIG. 1.

The makeup mirror set in FIG. 1 further includes a driving unit for driving the organic EL panels 25*a* to 25*d* and 26*a* to 26*d*. As shown in FIG. 5, the driving unit includes an AC-DC converter 61, a controller 62, a memory 63, and an operation unit 64. The AC-DC converter 61 converts alternating voltage to direct voltage and outputs the direct voltage. The output voltage from the AC-DC converter 61 is supplied as direct current power to the organic EL panels 25*a* to 25*d* and 26*a* to 26*d* and the controller 62. The controller 62 is operated by the output voltage from the AC-DC converter 61 as a power source and includes, for example, a CPU. The controller 62 controls the driving current for each of the RGB organic EL elements 50R, 50G, and 50B in the respective organic EL panels 25*a* to 25*d* and 26*a* to 26*d* to thereby control light emission (emission color and brightness) of each of the organic EL panels independently. The controller 62 serves as an adjustment unit for adjusting the color and brightness (luminosity) of the surface light sources.

The memory 63 and the operation unit 64 are further connected to the controller 62. Programs and data necessary for the control by the controller 62 are stored in the memory 63. The operation unit 64 is provided as a wired or wireless remote controller.

Figure 6:
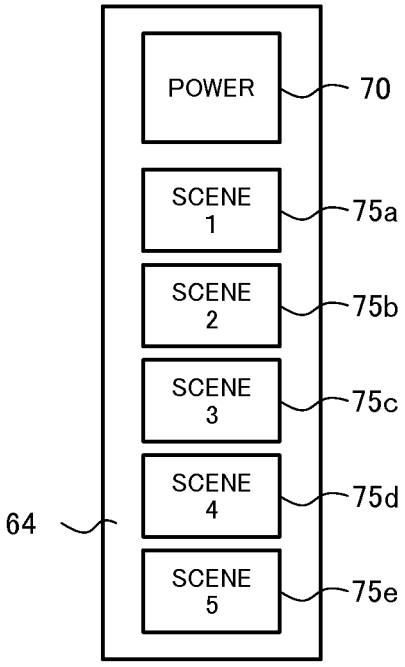
FIG. 6 is a diagram illustrating respective push buttons in an operation unit in the makeup mirror set in FIG. 1.

The operation unit 64 includes a power button 70 and scene buttons 75*a* to 75*e*, as shown in FIG. 6. After the user operates the power button 70 in the operation unit 64 to turn the power on, any one of the scene buttons 75*a* to 75*e* can be operated. The scene buttons 75*a* to 75*e* constitute the setting unit for setting illumination conditions of the surface light sources according to the input operations.

Illumination conditions, including color and brightness, for a plurality of scenes are pre-stored as date in the memory 63. Examples of the scenes include an office, a hotel lounge, a dinner party, a fashion show, and an outdoor location. RGB driving voltage values corresponding to optimal emission color and brightness for each of the organic EL panels 25*a* to 25*d* and 26*a* to 26*d* are stored as data in the memory 63.

The number of the scene buttons 75*a* to 75*e* provided is the same as the number of the plurality of scenes stored as data in the memory 63.

The driving unit further includes a playback unit 69 including a musical piece data storage unit 66, a playback processing unit 67, and an amplifier 68. The musical piece data storage unit 66 is, for example, a hard disk device or a nonvolatile semiconductor memory. Groups of musical piece data (e.g., MP3 data) of a plurality of musical pieces that are classified according to the above scenes (i.e., the illumination conditions) are stored in the musical piece data storage unit 66. The musical pieces in each of the data groups classified according to the scenes are further classified according to the length of illumination time. In this embodiment, the musical pieces are classified according to their melody into three musical piece groups, a first illumination time musical piece group to a third illumination time musical piece group. The first illumination time musical piece group includes musical pieces with slow tempo. The second illumination time musical piece group includes musical pieces with medium tempo, and the third illumination time musical piece group includes musical pieces with up tempo. However, the musical pieces data may be classified according to their melody into categories including healing music, popular music, rock music, etc.

The playback processing unit 67 selectively reads data of a musical piece from the musical piece data storage unit 66 according to a musical piece playback instruction from the controller 62 as described later, decodes the read data of the musical piece to generate an audio signal representing the musical piece, and then supplies the audio signal to the amplifier 68.

The amplifier 68 drives the speakers 16 and 17 according to the audio signal to cause the speakers 16 and 17 to output the musical piece.

In the driving unit configured as described above, when the user presses one of the scene buttons 75*a* to 75*e*, e.g., the scene button 75*a*, the controller 62 reads data of the scene corresponding to the scene button 75*a* (i.e., the RGB values for the organic EL panels 25*a* to 25*d* and 26*a* to 26*d*) from the memory 63. The controller 62 supplies driving currents to the RGB emission organic EL elements 50R, 50G, and 50B in the organic EL panels 25*a* to 25*d* and 26*a* to 26*d* according to the read data. Therefore, when the scene button 75*a* is operated, illumination conditions suitable for the scene corresponding to the scene button 75*a* can be produced. In addition, in response to the operation of the scene button 75*a*, the controller 62 supplies a musical piece playback instruction including the information about the scene corresponding to the scene button 75*a* to the playback processing unit 67.

Figure 7:
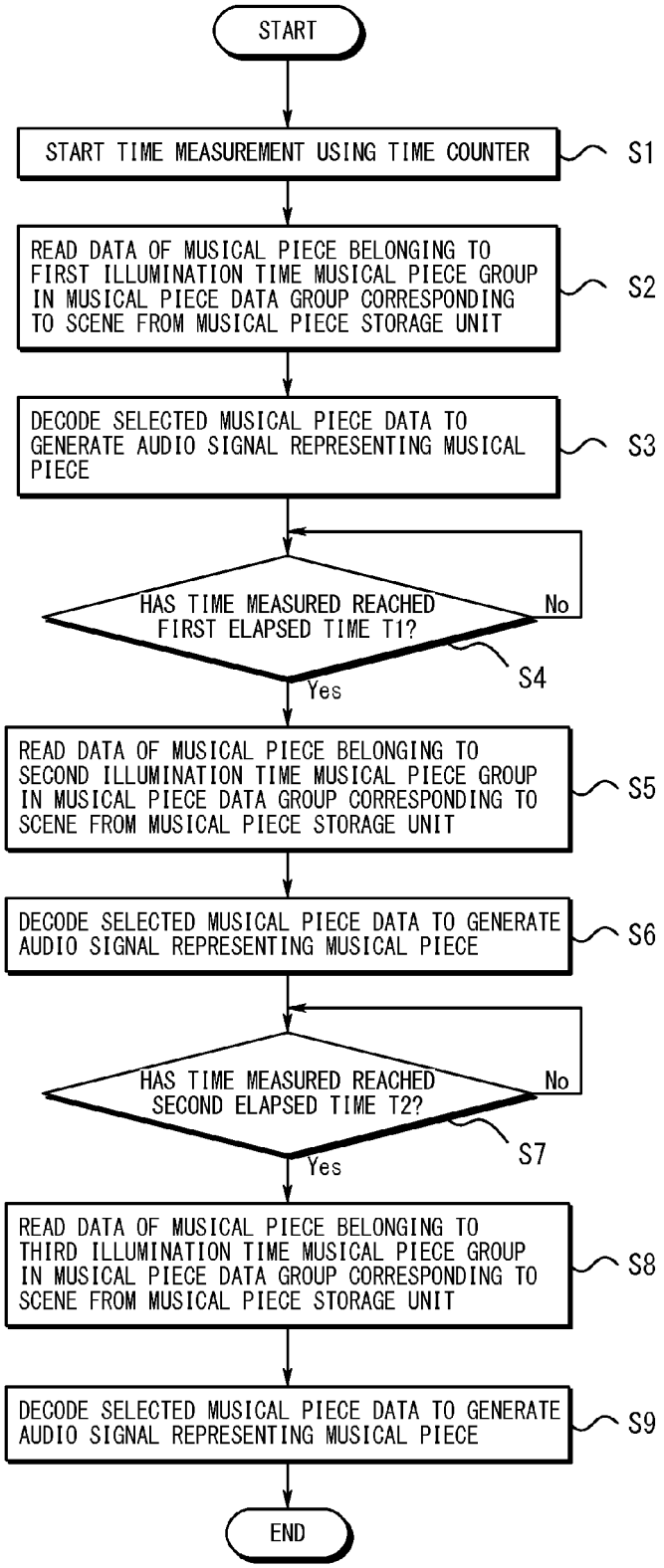
FIG. 7 is a flowchart showing an operation of a playback processing unit in FIG. 5.

Upon reception of the musical piece playback instruction, the playback processing unit 67 starts time measurement using a time counter (not shown) as shown in FIG. 7 (step S1). Step S1 is executed to measure the time of illumination with the organic EL panels 25*a* to 25*d* and 26*a* to 26*d* started by operation of the scene button 75*a*. After execution of step S1, data of a musical piece in the first illumination time musical piece group belonging to the musical piece data group corresponding to the scene included, as information, in the musical piece playback instruction supplied from the controller 62 is read selectively from the musical piece data storage unit 66 (step S2). Then the read selected musical piece data is decoded to generate an audio signal representing the musical piece, and the audio signal is supplied to the amplifier 68 (step S3). The audio signal is amplified by the amplifier 68 and then supplied to the speakers 16 and 17. The speakers 16 and 17 output a playback sound for the read selected musical piece data. The playback sound is a musical piece with slow tempo that is suitable for the scene corresponding to the scene button 75*a*.

After execution of step S3, the playback processing unit 67 determines whether or not the time measured by the time counter has reached first elapsed time T1 (e.g., 10 minutes) (step S4). If the time measured has not reached the first elapsed time T1, the generation of the audio signal in step S3 is continued. When the generation of the audio signal for the data of the musical piece in step S3 finishes, the process may return to step S2. In this case, the data of another musical piece belonging to the first illumination time musical piece group in the musical piece data group assigned to the selected scene is selectively read from the musical piece data storage unit 66, and the read data of the musical piece is decoded to produce an audio signal.

If the determination result in step S4 shows that the time measured has reached the first elapsed time T1, the data of a musical piece in the second illumination time musical piece group in the musical piece data group assigned to the selected scene is selectively read from the musical piece data storage unit 66 (step S5). Then the read selected musical piece data is decoded to generate an audio signal representing the musical piece, and the audio signal is supplied to the amplifier 68 (step S6). The speakers 16 and 17 output a playback sound for the read selected musical piece data. The playback sound is a musical piece with medium tempo that is suitable for the scene corresponding to the scene button 75*a*.

After execution of step S6, a determination is made as to whether or not the time measured has reached second elapsed time T2 (e.g., 20 minutes, T2>T1) (step S7). If the time measured has not reached the second elapsed time T2, the generation of the audio signal in step S6 is continued. Even when the time measured has not reached the second elapsed time T2, if the generation of the audio signal for the data of the musical piece in step S6 finishes, the process may return to step S5. In this case, the data of another musical piece belonging to the second illumination time musical piece group in the musical piece data group assigned to the selected scene is selectively read from the musical piece data storage unit 66, and the read data of the musical piece is decoded to produce an audio signal.

If the determination result in step S7 shows that the time measured has reached the second elapsed time T2, the data of a musical piece belonging to the third illumination time musical piece group in the musical piece data group assigned to the selected scene is selectively read from the musical piece data storage unit 66 (step S8). Then the read selected musical piece data is decoded to generate an audio signal representing the musical piece, and the audio signal is supplied to the amplifier 68 (step S9). The speakers 16 and 17 output a playback sound for the read selected musical piece data. The playback sound is a musical piece with up tempo that is suitable for the scene corresponding to the scene button 75*a*.

When the generation of the audio signal for the data of the musical piece in step S9 finishes, the process may return to step S8. In this case, the data of another musical piece belonging to the third illumination time musical piece group in the musical piece data group assigned to the selected scene is selectively read from the musical piece data storage unit 66, and the read data of the musical piece is decoded to produce an audio signal.

As described above, during application of makeup to the makeup subject under illumination conditions suitable for the scene corresponding to the scene button 75*a*, a musical piece is outputted from the speakers 16 and 17. As the makeup progresses, a musical piece with, for example, faster tempo is played. This can lighten the mood of the makeup subject as the makeup progresses, and therefore the makeup subject can wear the makeup in a good mood.

In the above embodiment, the operation when the user presses the scene button 75*a* among the scene buttons 75*a* to 75*e* is pressed has been described. The operation when one of the scene buttons 75*b* to 75*e* except for the scene button 75*a* is pressed is the same as the operation when the scene button 75*a* is pressed. For example, when the scene button 75*c* is pressed, illumination conditions suitable for the scene corresponding to the scene button 75*c* are formed by light emitted from the organic EL panels 25*a* to 25*d* and 26*a* to 26*d*. Simultaneously, a musical piece suitable for the scene corresponding to the scene button 75*c* is outputted from the speakers 16 and 17 during application of makeup to the makeup subject. As the makeup progresses, a musical piece with, for example, faster tempo is played.

Figure 8:
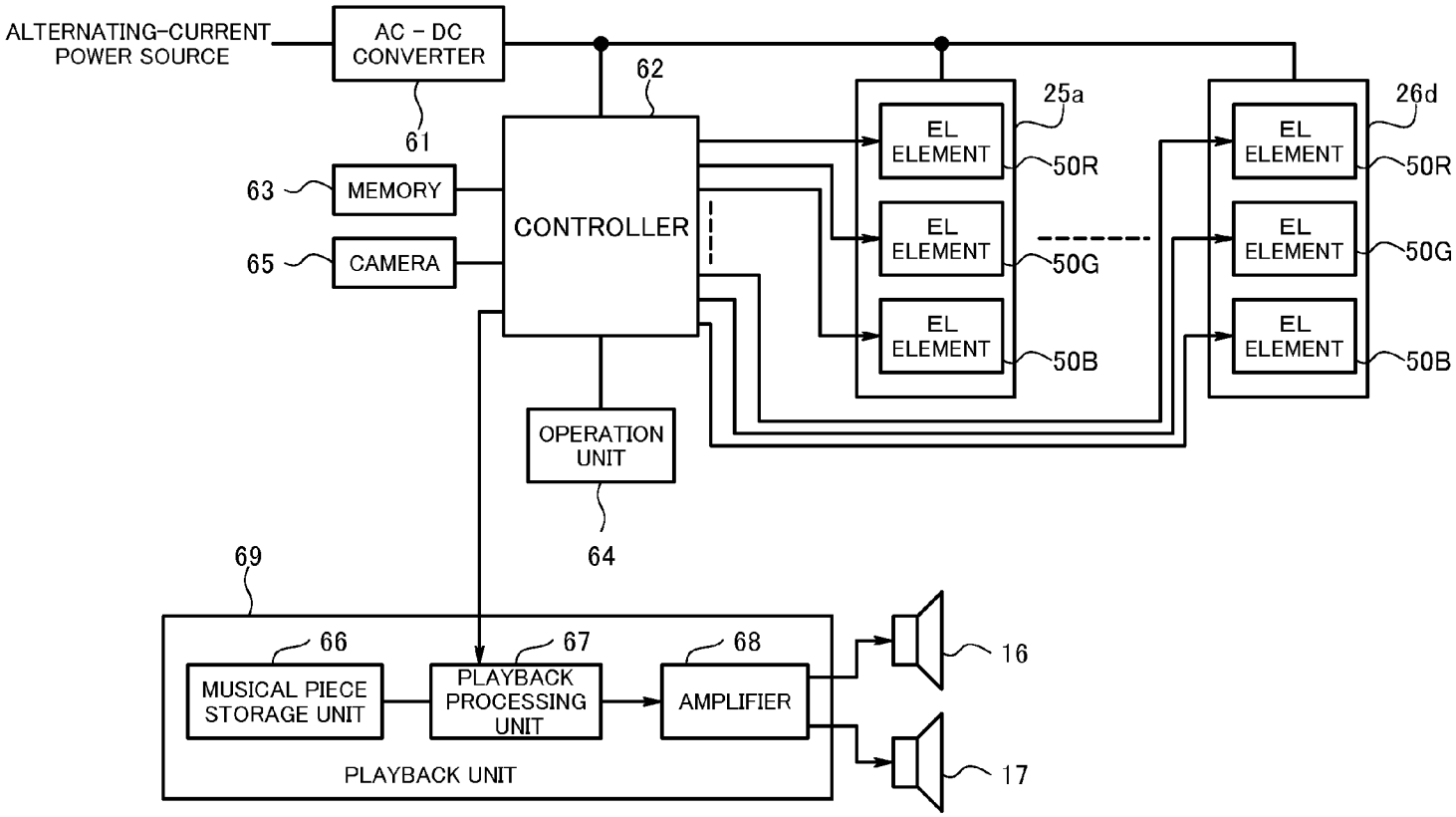
FIG. 8 is a block diagram illustrating the configuration of a driving unit in the illuminated makeup mirror set as another embodiment of the present invention.

FIG. 8 shows the configuration of a driving unit in the illuminated makeup mirror set in FIG. 1 as another embodiment of the present invention. In the driving unit shown in FIG. 8, a camera 65 is connected to the controller 62. The rest of the configuration is the same as the configuration of the driving unit shown in FIG. 5, and the same reference numerals are used in FIG. 8.

Figure 9:
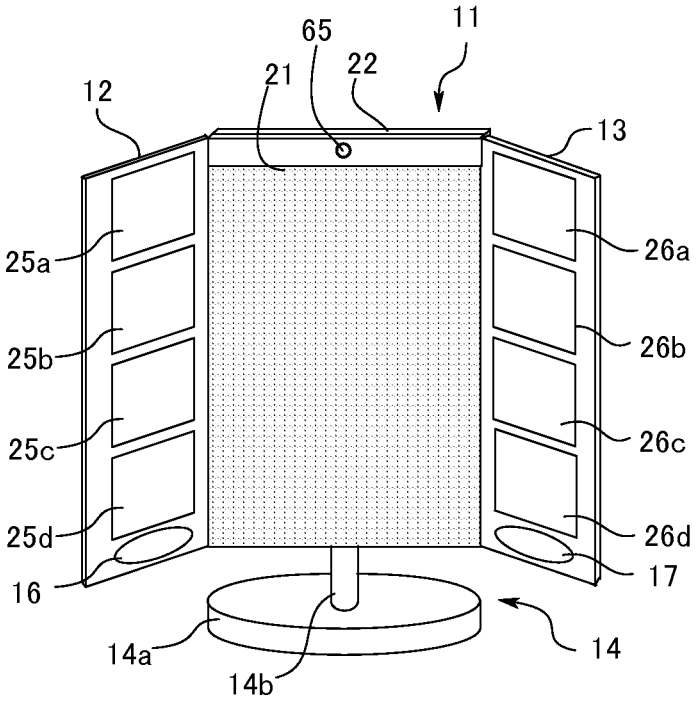
FIG. 9 is an external view of an illuminated makeup mirror set including a camera in the driving unit in FIG. 8.

The camera 65 is attached to the upper portion of the flat plate 22 of the mirror unit 11 as shown in FIG. 9. However, the camera 65 may be disposed in any of the left and right side plates 12 and 13 and an upper plate 14, or the user may hold and operate the camera 65. In the makeup mirror set, the camera 65 captures an image of the face of makeup subject, for example, immediately after the power button 70 in the operation unit 64 is pressed and supplies the video signal of the captured image to the controller 62.

Upon reception of the supplied video signal, the controller 62 recognizes the degree of progress of the makeup on the face of the makeup subject from a subject image represented by the video signal (the controller 62 serves as a recognition unit). The degree of progress of the makeup can be determined, for example, according to the difference between the brightness of the outline of the eyes and the brightness of the skin around the eyes. The controller 62 supplies the recognized degree of progress of the makeup as information to the playback processing unit 67. In this embodiment, the degree of progress of the makeup is divided into first to third makeup progress degrees. As the makeup progresses, the recognized degree of progress of the makeup changes from the first makeup progress degree to the second makeup progress degree and then to the third makeup progress degree in that order.

The playback processing unit 67 uses the degree of progress of the makeup supplied as information from the controller 62 as information corresponding to the illumination time, selectively reads, from the musical piece data storage unit 66, the data of a musical piece in an illumination time musical piece group that corresponds to the degree of progress of the makeup and is included in a musical piece group assigned to a scene, and then decodes the data of the music piece to generate an audio signal. In the first makeup progress degree, the data of a music piece belonging to the first illumination time musical piece group is selected. In the second makeup progress degree, the data of a music piece belonging to the second illumination time musical piece group is selected. In the third makeup progress degree, the data of a music piece belonging to the third illumination time musical piece group is selected.

By recognizing the degree of progress of the makeup on the makeup subject and using the recognized information to select the data of a musical piece, the mood of the makeup subject can be lightened as the makeup progresses, and therefore the makeup subject can wear the makeup in a good mood.

Figure 10:
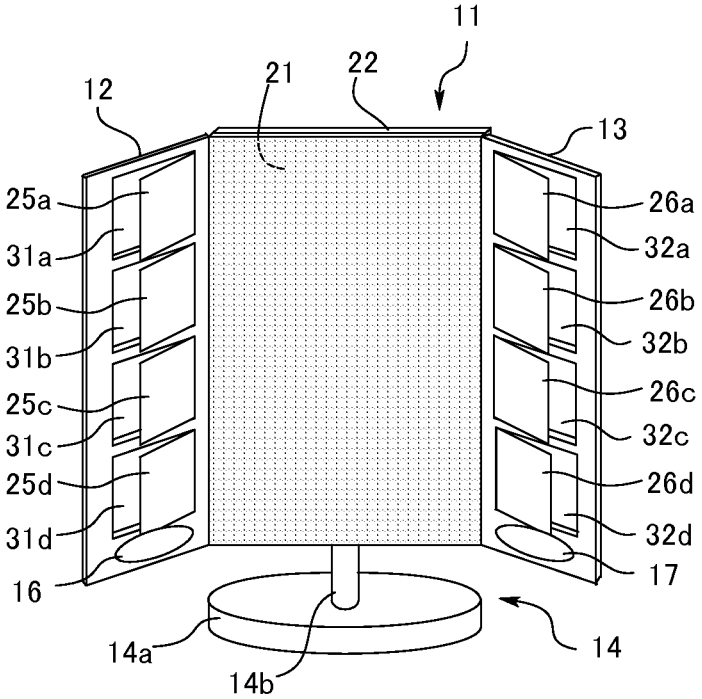
FIG. 10 is an external view of angle-adjustable organic EL panels for the makeup mirror set in FIG. 1.

In the makeup mirror set in the above embodiment, the angles of the organic EL panels 25*a* to 25*d* and 26*a* to 26*d* with respect to the side plates 12 and 13 may be adjustable as shown in FIG. 10. In the organic EL panels 25*a* to 25*d* and 26*a* to 26*d*, their edge close to the mirror unit 11 serves as a rotation axis so that the angles of the organic EL panels 25*a* to 25*d* and 26*a* to 26*d* are adjustable. For example, the side plates 12 and 13 are connected to the organic EL panels 25*a* to 25*d* and 26*a* to 26*d* through hinge mechanisms (not shown) to allow the edges of the organic EL panels 25*a* to 25*d* and 26*a* to 26*d* close to the mirror unit 11 to serve as rotation axes. As shown in FIG. 10, openings 31*a* to 31*d* and 32*a* to 32*d* that can accommodate the organic EL panels 25*a* to 25*d* and 26*a* to 26*d* may be formed in the side plates 12 and 13 at positions corresponding to the organic EL panels 25*a* to 25*d* and 26*a* to 26*d*. When the angles of the organic EL panels 25*a* to 25*d* and 26*a* to 26*d* with respect to the side plates 12 and 13 are adjustable as described above, the angle of each of the organic EL panels can be freely adjusted, so that more suitable illumination conditions can be produced.

In the above embodiment, one set of illumination conditions is selected from a plurality of sets of preset illumination conditions according to an input operation by the user through the operation unit 64. However, the user may operate the operation unit 64 to designate RGB values or emission color and brightness for each of the organic EL panels to thereby set illumination conditions, and the organic EL panels 25*a* to 25*d* and 26*a* to 26*d* may be driven according to the set illumination conditions.

Figure 11:
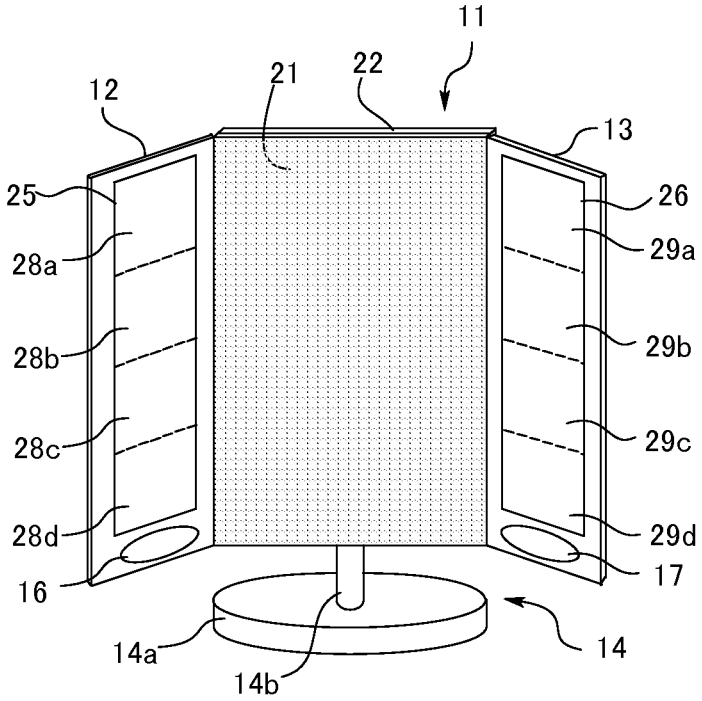
FIG. 11 is an external view of an illuminated makeup mirror set including single surface light sources each having a light-emitting surface divided into a plurality of regions driven independently.

FIG. 11 shows an illuminated makeup mirror set including single surface light sources each having a light-emitting surface divided into a plurality of regions driven independently. For example, in the embodiment shown in FIG. 1, the plurality of organic EL panels 25*a* to 25*d* and 26*a* to 26*d* are attached to the side plates 12 and 13. However, as shown in FIG. 11, single elongated organic EL panels 25 and 26 may be attached to the side plates 12 and 13. In the illuminated makeup mirror set in FIG. 9, the light-emitting surface of each of the organic EL panels 25 and 26 is divided into a plurality of regions, e.g., four regions 28*a* to 28*d* or 29*a* to 29*d*, as shown by dotted lines in FIG. 11. The controller drives each of these regions according to the input operation by the user from the operation unit in the same manner as in the driving of each panel in the above-described embodiment, and the emission color and brightness of each region are adjusted according to the scene.

REFERENCE NUMERALS

11 Mirror unit
12, 13 Side plate
14 Support
15 Hinge mechanism
16, 17 Speaker
25, 26, 25*a* to 25*d*, 26*a* to 26*d* Organic EL panel
50R, 50G, 50B Organic EL element
69 Playback unit

The invention claimed is:

1. An illumination set including a mirror, comprising:
surface light sources disposed in a fringe of the mirror;
a setting unit configured to set a luminosity for the surface light sources according to an input operation;
an adjustment unit configured to adjust the surface light sources according to the luminosity set by the setting unit;
an output unit outputting a reproduced sound and being disposed in the fringe of the mirror;
side plates disposed at side edges of the mirror; and
a processing unit configured to selectively play a musical piece selected from a plurality of musical pieces according to the luminosity of the surface light sources, wherein the setting unit is configured to select one luminosity for the surface light sources from a plurality of preset luminosities according to the input operation and set the selected luminosity.

2. The illumination set according to claim 1,
wherein the surface light sources are disposed on the one or more side plates.

3. The illumination set according to claim 1, wherein a loudspeaker as the output unit is disposed on the side plates.

4. The illumination set according to claim 1, further comprising a flexible hinge mechanism configured to attach the side plates to a side edge of the mirror such that an angle of the side plate with respect to the mirror is adjustable.

5. The illumination set according to claim 1, wherein the output unit is disposed at positions below the surface light sources without being disposed behind the mirror.

6. An illumination set including a mirror, comprising:
surface light sources;
a setting unit configured to set a luminosity for the surface light sources according to an input operation;
an adjustment unit configured to adjust the one or more surface light sources according to the luminosity set by the setting unit;
a processing unit configured to selectively play a musical piece selected from a plurality of musical pieces according to a time of illumination of the surface light sources;
side plates disposed at side edges of the mirror;
and
an output unit configured to output the selected musical piece as a reproduced sound, wherein the output unit is disposed on the side plates.

7. The illumination set according to claim 6, comprising:
a storage configured to store the plurality of musical pieces as data,
wherein the processing unit is configured to select the musical piece from the plurality of musical pieces stored in the storage.

8. The illumination set according to claim 6, further comprising a recognition unit configured to recognize a degree of progress of makeup application on a subject image that is reflected in the mirror,
wherein the processing unit is further configured to obtain a degree of progress from the recognition unit as information corresponding to the measured illumination time, select a musical piece corresponding to the degree of progress from a group of musical pieces that correspond to the measured illumination time, and play the selected musical piece.

9. The illumination set according to claim 6, wherein the setting unit is configured to select one luminosity for the surface light sources from a plurality of preset luminosities according to the input operation and set the selected luminosity.

10. The illumination set according to claim 6, further comprising a flexible hinge mechanism configured to attach the side plates to a side edge of the mirror such that an angle of the side plate with respect to the mirror is adjustable.

* * * * *